US007082982B2

(12) United States Patent
Eveland et al.

(10) Patent No.: US 7,082,982 B2
(45) Date of Patent: Aug. 1, 2006

(54) RETROFIT DOORLIGHT BLIND ASSEMBLY

(75) Inventors: Mike S. Eveland, Fennville, MI (US); Andrew R. Krochmal, Grand Haven, MI (US); Michele M. Dorcic-Lechenet, Hamilton, MI (US)

(73) Assignee: ODL, Incorporated, Zeeland, MI (US)

( * ) Notice: Subject to any disclaimer, the term of this patent is extended or adjusted under 35 U.S.C. 154(b) by 263 days.

(21) Appl. No.: 10/878,588

(22) Filed: Jun. 28, 2004

(65) Prior Publication Data

US 2004/0238131 A1 Dec. 2, 2004

Related U.S. Application Data

(63) Continuation of application No. 10/268,545, filed on Oct. 10, 2002, now Pat. No. 6,817,401.

(51) Int. Cl.
*A47H 1/00* (2006.01)

(52) U.S. Cl. ..... 160/107; 160/168.1 R; 160/176.1 R; 49/64

(58) Field of Classification Search ..... 160/107, 160/176.1 R, 177 R, 168.1 R, 172, 173, 160/174, 178.1 R, 170, 171; 49/64, 82.1, 49/87.1, 74.1
See application file for complete search history.

(56) References Cited

U.S. PATENT DOCUMENTS

| | | | | | |
|---|---|---|---|---|---|
| 2,389,956 | A | | 11/1945 | Castilonia | |
| 2,434,786 | A | * | 1/1948 | Browning | 160/34 |
| 2,557,978 | A | | 6/1951 | Krumm | |
| 2,629,466 | A | * | 2/1953 | Nardulli | 49/451 |
| 2,639,766 | A | | 5/1953 | Pratt | |
| 2,877,840 | A | * | 3/1959 | Hurowitz et al. | 160/91 |
| 3,201,832 | A | | 8/1965 | Hordis et al. | |
| 3,291,193 | A | * | 12/1966 | Hagerty et al. | 160/107 |
| 3,318,360 | A | | 5/1967 | Persson | |
| 3,342,243 | A | | 9/1967 | Salter | |
| 3,443,624 | A | | 5/1969 | Toth | |
| 3,703,920 | A | | 11/1972 | Debs | |
| 3,719,221 | A | | 3/1973 | Hanson | |
| 3,795,267 | A | | 3/1974 | Debs | |
| 3,881,539 | A | * | 5/1975 | Falgas | 160/107 |
| 4,064,651 | A | * | 12/1977 | Homs | 49/319 |
| 4,459,778 | A | | 7/1984 | Ball | |
| 4,588,012 | A | | 5/1986 | Anderson | |
| 4,664,169 | A | | 5/1987 | Osaka et al. | |
| 4,679,610 | A | | 7/1987 | Spraggins | |
| 4,817,698 | A | | 4/1989 | Rossini et al. | |
| 4,979,552 | A | | 12/1990 | van der Zanden | |
| 4,998,576 | A | * | 3/1991 | Moreno | 160/90 |
| 5,141,041 | A | * | 8/1992 | Katz et al. | 160/84.02 |
| 5,178,200 | A | | 1/1993 | Hagen | |

(Continued)

FOREIGN PATENT DOCUMENTS

| | | | | |
|---|---|---|---|---|
| CH | 684205 | * | 7/1994 | 160/170 X |
| FR | 2646205 | | 10/1990 | |
| FR | 2672335 | | 8/1992 | |
| FR | 2783277 | * | 9/1998 | 160/170 X |
| WO | WO 90/15914 | | 12/1990 | |

*Primary Examiner*—Bruce A. Lev
(74) *Attorney, Agent, or Firm*—Warner Norcross & Judd

(57) ABSTRACT

A retrofit blind assembly for a doorlight. The assembly includes a frame, a transparent panel, and a blind snap-fitted to the frame. The blind actuator includes gears and a toothed belt for positive, non-slip actuation. A pair of blind guides are mounted on the opposite sides of the frame to receive and guide the opposite ends of the blind. The mounting system includes a pair of brackets that can be secured between the doorlight and the door and upon which the assembly can be hung. The mounting system also includes a pair of movable catches on the lower portion of the frame snap that can be locked behind the doorlight to secure the lower end of the assembly.

8 Claims, 8 Drawing Sheets

U.S. PATENT DOCUMENTS 5,226,466 A 7/1993 Coddens
5,282,504 A * 2/1994 Anderson et al. ..... 160/107
5,318,090 A * 6/1994 Chen ..... 160/171
5,379,825 A 1/1995 Jelic
5,396,944 A 3/1995 Rossini
5,584,459 A * 12/1996 Meyer ..... 248/251
5,662,154 A * 9/1997 Drake, III ..... 160/176.1 R
5,699,845 A 12/1997 Jelic
RE35,926 E 10/1998 Hagen
5,826,638 A 10/1998 Jelic
5,839,492 A * 11/1998 Young ..... 160/107
5,996,668 A * 12/1999 DeBlock et al. ..... 160/107
6,006,813 A * 12/1999 Jelic ..... 160/107
6,105,652 A * 8/2000 Judkins ..... 160/115
6,481,486 B1 * 11/2002 Sanz et al. ..... 160/84.06
6,601,633 B1 * 8/2003 Sun et al. ..... 160/107
2003/0015301 A1 * 1/2003 Killo et al. ..... 160/310
2003/0075285 A1 * 4/2003 Anderson et al. ..... 160/90
2003/0173036 A1 * 9/2003 Kwon et al. ..... 160/107

* cited by examiner

RETROFIT DOORLIGHT BLIND ASSEMBLY

This is a continuation of application Ser. No. 10/268,545, filed Oct. 10, 2002 (now U.S. Pat. No. 6,817,401).

BACKGROUND OF THE INVENTION

The present invention relates to window blind assemblies and, more particularly, to a blind assembly particularly well adapted for mounting over doorlights.

Window units incorporating blinds are well known in the prior art. These units include two panes of glass an a blind assembly sandwiched between the two panes. The blind assemblies include mechanisms both for raising and lowering the blinds and for tilting the blind slats. The units include slides or knobs or handles coupled to the mechanisms and accessible from the outside of the unit. When a window unit is especially designed or adapted for installation in a door, the unit is referred to as a doorlight.

Because it is difficult, time-consuming and costly to replace existing doorlights with doorlights having integral blinds, retrofit assemblies have been developed for retrofitting blinds over doorlights. These retrofit assemblies include a frame that supports both a pane of glass and a blind assembly. The frame is attached over the frame of the existing doorlight such that the blind assembly is sandwiched between the pane of the assembly and the existing doorlight. Screws are typically used to attach the assembly to the doorlight and/or the door. One particularly good example of a retrofit assembly is illustrated in U.S. Pat. No. 5,996,668 issued Aug. 14, 1998 to DeBlock et al.

Retrofit units are superior to the simple attachment of a blind assembly first because the retrofit units protect the blinds from wear and tear and encase the cords of the blind assembly. Freely hanging cords can be a hazard to children and pets. Second, the retrofit unit confines the blind and prevents the blind from swinging into the door as the door is opened and closed or during high winds, thus preventing damage to the blind and the door. Finally, the encased window blind is more aesthetically pleasing than a traditionally hung window blind; and the encased blind requires cleaning less frequently, if ever.

Despite the advantages of these systems, there is room for improvement. First, the cords in the units can become tangled if the blind is permitted to free fall within the unit and/or if the unit is inverted (e.g. prior to or during installation). Second, the mechanism of the units often are visible along the sides or edges, contributing to an unsightly appearance. Third, the units require a considerable amount of time to install. Fourth, the fasteners for the units leave permanent marks (e.g. holes) in the face of the door, which are unsightly if the retrofit unit is removed. Fifth, stocking of units of blinds having different colors creates a significant inventory issue. Sixth, replacing a blind in a unit is extremely difficult, if not impossible. This can be a problem if a consumer wishes to change the color of the blind assembly or if a defective blind must be replaced. A consumer usually replaces the entire unit if they wish to change the color of the blind.

SUMMARY OF THE INVENTION

The present invention overcomes the noted problems by providing a an improved retrofit doorlight blind assembly having several novel features.

In a first aspect of the invention, the operator mechanism for the raise/lower feature includes gears and a toothed drive belt to ensure positive engagement of the drive mechanism. More particularly, a first gear drives the blind operator rod; a second gear provides an idler, and the toothed belt is looped around the two gears to provide the driving mechanism.

In a second aspect of the invention, the frame includes multipurpose blind guides. First, the guides have a C-shaped section that surrounds the edges of the blind to guide the blind during raising and lowering. Second, the guides secured the glass panel within the frame. Third, the guides hide the mechanism from view. And, fourth, the guides reinforce the frame.

In a third aspect of the invention, the assembly includes an improved mounting system for mounting the retrofit assembly over a doorlight. More specifically, the mounting system includes a top bracket that is secured behind the top of the doorlight frame on which the assembly is easily hung. The system also include latches that lock behind a lower portion of the doorlight frame to secure the bottom of the assembly.

In a fourth aspect of the invention, the blind snap-fits into the assembly frame so that the blind is easily attached to and detached from the frame. Specifically, the blind assembly includes a catch that snaps into a slot on the header. This feature reduces inventory, because assemblies can be made to order by snapping any one of a plurality of blinds (e.g. having a desired feature such as color) into a common frame. This feature also facilitates subsequent changes to the assembly, such as replacing a blind having one feature with a blind have a different feature.

In a fifth aspect of the invention, the blind actuator rod includes an improved technique for securing the actuator cords. More specifically, small barrels are mounted transversely in the rod; and the actuator cords are secured within the barrels. This technique eliminates the prior art need to glue the cords to the barrel, with the attendant manufacturing difficulties and costs.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
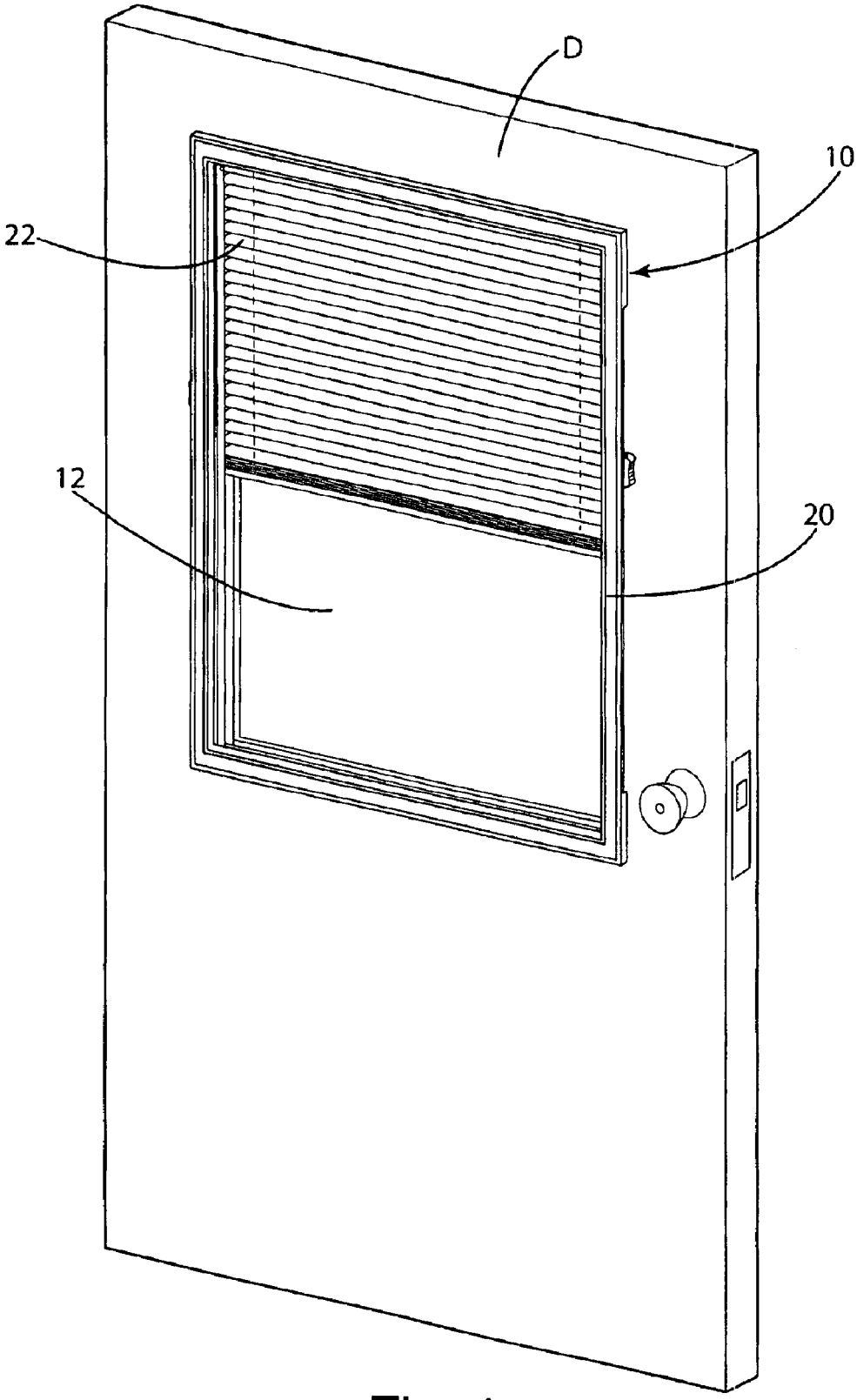
FIG. 1 is a front elevational view of a door incorporating the blind assembly of the present invention.
Figure 2:
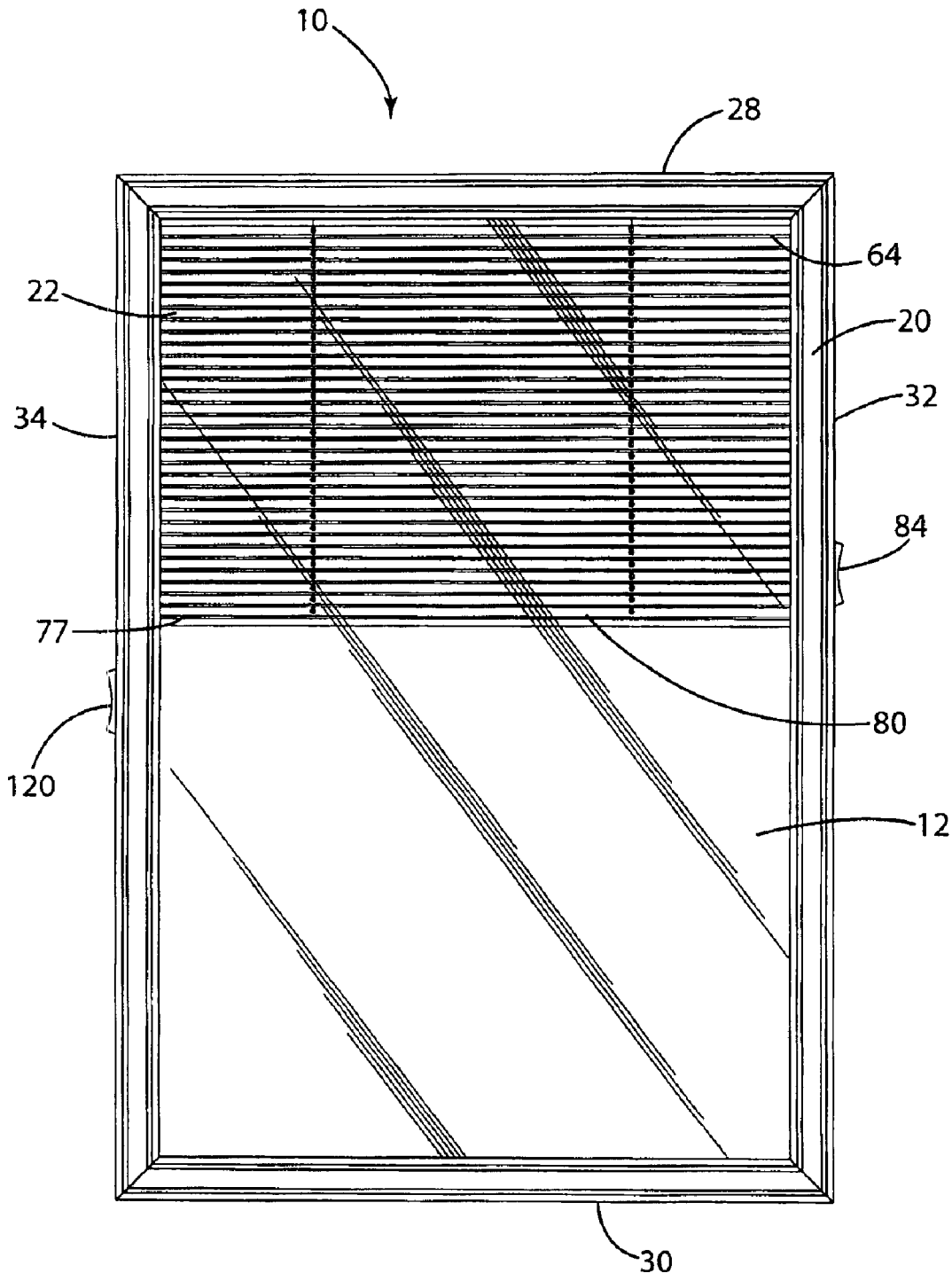
FIG. 2 is a front elevational view of the blind assembly.
Figure 3:
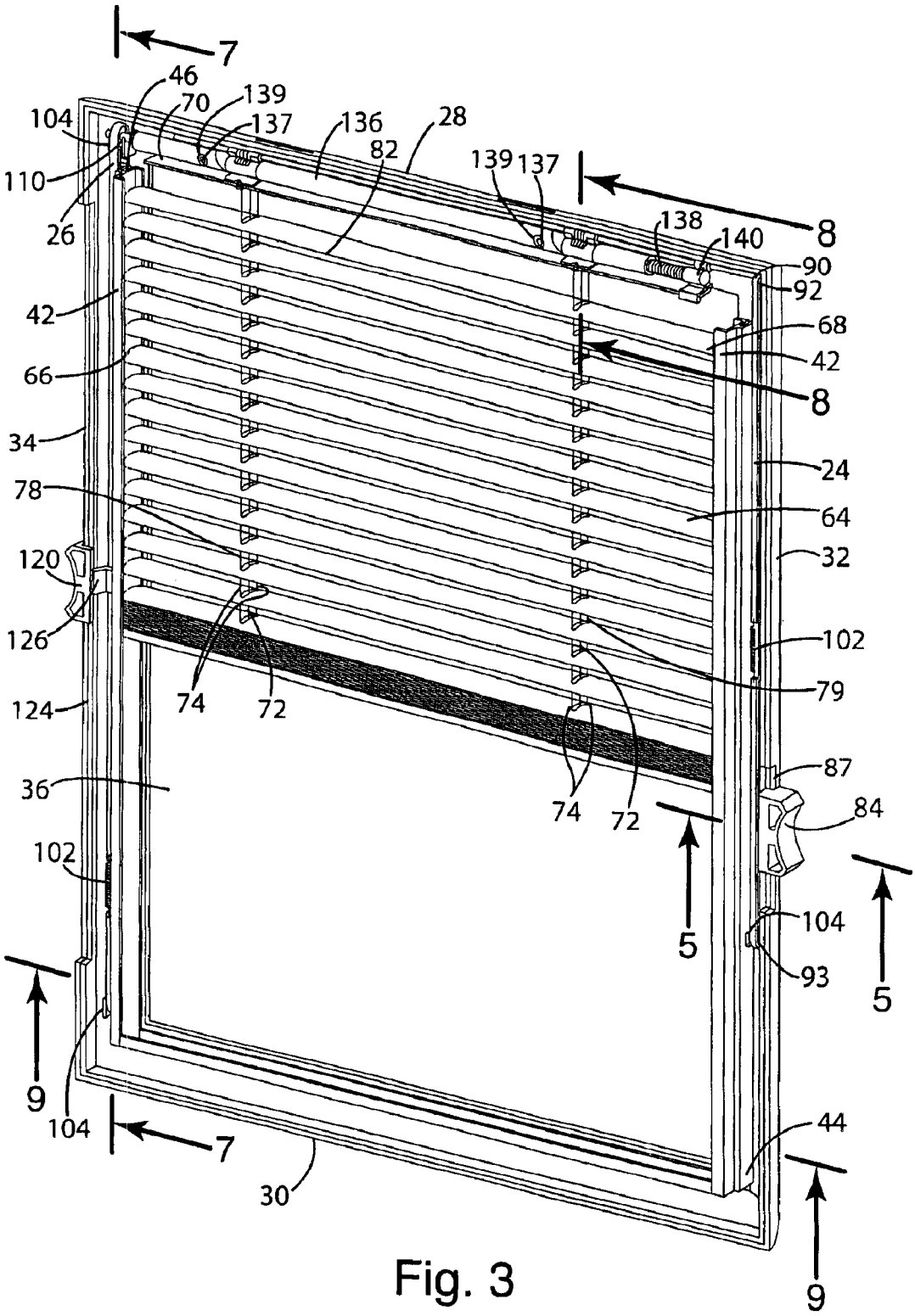
FIG. 3 is a rear perspective view of the assembly.

A blind assembly according to a preferred embodiment of this invention is illustrated in FIGS. 1–3 and generally designated 10.

I. Structure

The assembly 10 includes a window pane 12, a frame 20, a set of blinds 22, a tilt control mechanism 24, and a height control mechanism 26. The assembly 10 is described for installation over a door D and doorlight L. However, the assembly 10 may be installed over other, various window types.

The frame 20 is preferably molded of plastic, although other materials, such as wood or metal, may be used. The frame 20 includes top and bottom sides 28 and 30 and left and right sides 32 and 34. The sides 28, 30, 32, and 34 meet at right angles and form a rectangle, although the frame 20 may include a larger or smaller number of sides and form other shapes, such as a triangle or octagon. A pane opening 36 is defined in the center of the frame 20. Although the frame will be described with reference to a rectangular pane opening 36, and accordingly a rectangular window pane 12, it is to be understood that the opening can be of essentially any shape, such as oval or triangular.

Figure 4:
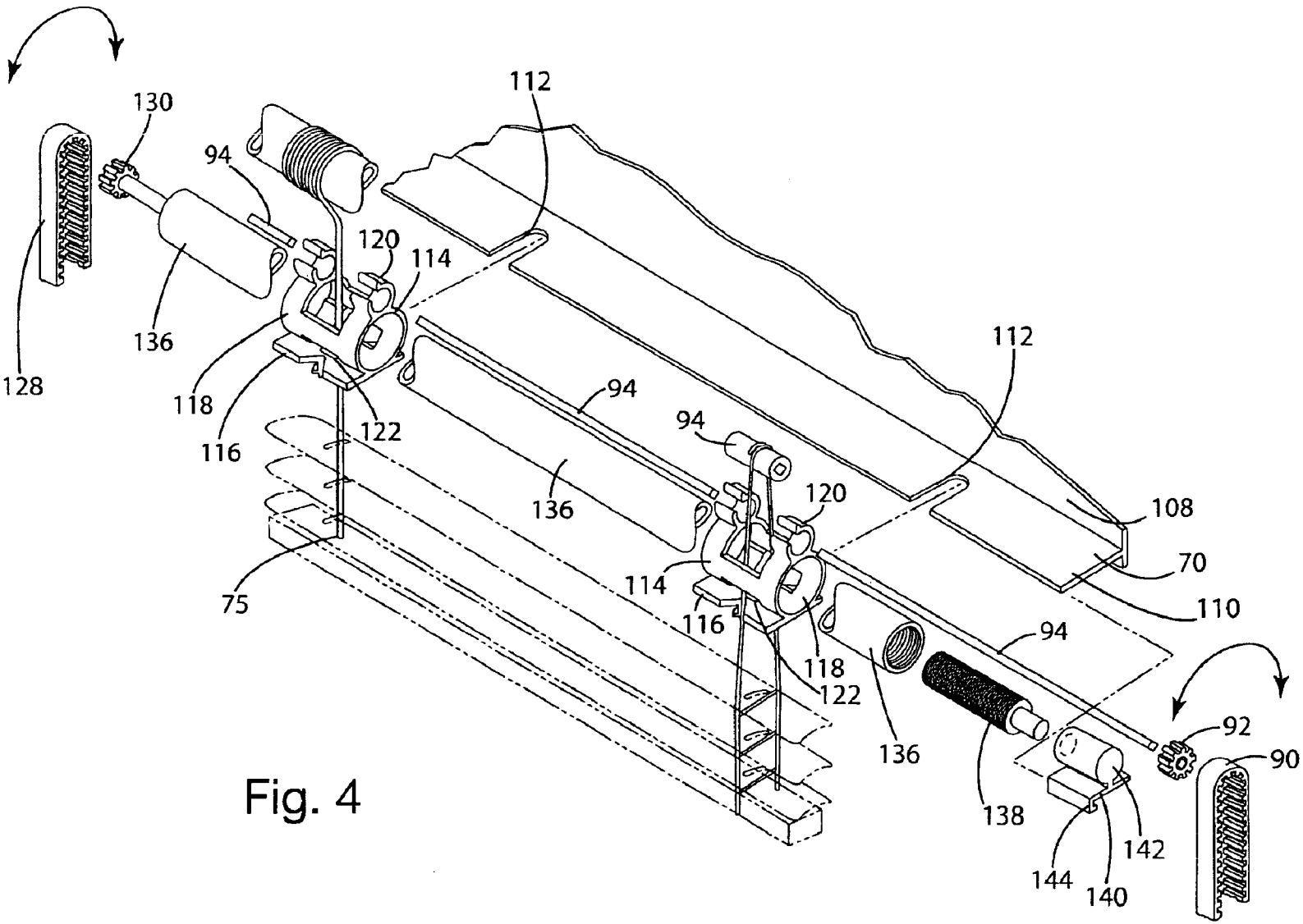
FIG. 4 is an exploded fragmentary view of the assembly.

As seen in FIG. 4, each of the bottom, left and right sides 30, 32, and 34 of the frame 20 includes a rib 40, extending along its length. The rib 40 is a substantially rectangular protrusion that extends approximately the length of the pane opening 36 on each side of the frame 20. The rib 40 is preferably integrally molded as part of the frame 20, however the rib 40 may be separately formed and attached to the frame 20 by conventional means.

Connected to each rib 40 is a blind guide 42. Blind guides 42 are preferably molded of plastic, but may be produced of other materials such as metal or plastic. As will be explained below, the blind guides 42 guide the blinds 22 during use and secure the pane 12 to the frame 20. Further, the blind guides 42 reinforce the frame 20 and prevent viewing of the internal workings of the assembly 10 when the assembly is installed. Each blind guide 42 has a connecting portion 44 and a blind retainer 46.

Figure 5:
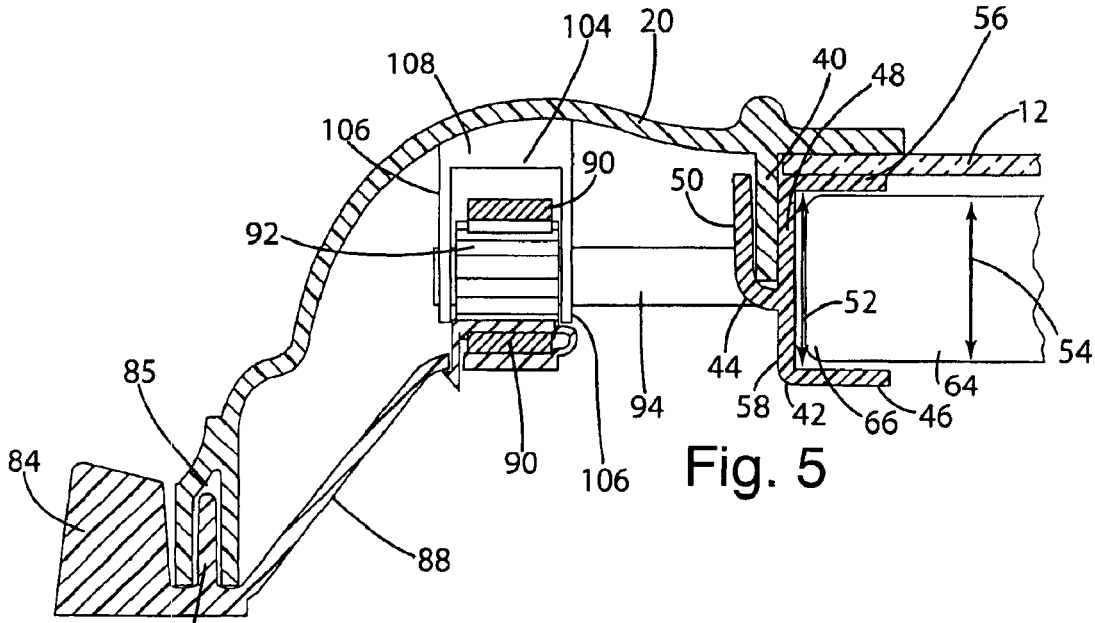
FIG. 5 is a top cross-sectional view of the assembly showing the blinds retained in the frame taken along the line V—V in FIG. 3.

The connecting portion 44 is a substantially U-shaped section of each blind guide 42 that defines a cavity, the cavity fitting over a rib 40 of the frame 20. As shown in FIG. 5, the dimensions of the connecting portion 44 are preferably such that there is a close fit between each connecting portion 44 and the corresponding rib 40. When connected to the rib 40, a first leg 48 of the connecting portion 44 is in contact with the pane 12 and a second leg 50 of the connecting portion 44 is in contact with the frame 20. This construction secures the pane 12 to the frame 10. The connecting portion 44 can be connected to the rib 40 by any conventional means, such as the use of glue or fasteners.

Further, each blind guide 42 includes a blind retainer 46. The blind retainer is an essentially C-shaped section of the blind guide 42 and is connected to the connecting portion 44. The width 52 of the blind retainer 46 is approximately equal to the width 54 of the blinds 22. When connected, the open side of the blind retainer 46 faces the pane 12 of the assembly 10, providing a channel for the blinds 22 to travel in as they are raised and lowered during use. As with the connecting portion 44, the blind guide has one leg 56 that contacts the pane 12 of the assembly 10.

The connecting portion 44 and blind retainer 46 are preferably molded as an integral piece, though the elements can be formed separately and later connected. If molded as an integral piece, the back leg 58 of the blind retainer 46 and the first leg 48 of the connecting portion 44 are preferably molded as a single leg, thus connecting the two sections. If not molded as an integral piece, the back leg 58 of the blind retainer 46 is preferably connected to the first leg 48 of the connecting portion 44 by conventional means, such as the use of glue or other adhesive.

The set of blinds 22 are conventional window blinds and, therefore, will not be described in detail. The blinds include a plurality of slats 64, preferably manufactured of vinyl or aluminum; of course, other materials such as wood may be used. As discussed above, the blinds 22, and specifically the ends 66 and 68 of the slats 64 of the blinds 22, are loosely retained in the blind retainers 46 of the left and right sides 32 and 34 of the frame 20. A header 70, as seen in FIG. 4, from which the slats 64 are suspended, is fixedly mounted on the top side 28 of the frame 20. The slats 64 are suspended from conventional lift adjustment and tilt adjustment, or string ladder, tilt cords 74. The lift cords 72 have first and second ends 75 and 76; the first ends 75 are threaded through apertures (not shown) defined by the slats 64 and secured to the lowermost slat 77. The second end 76 of each lift cord 72 is secured within the header 70. Front and rear tilt cords 78 and 79 extend along the front and rear edges 80 and 82 of the slats 64. A connector cord (not shown) extends between the front and rear tilt cords 74 and supports each slat 64. The tops of the tilt cords 74 are secured within the header 70.

The header 70 is a substantially L-shaped bar that is connected to the top side 28 of the frame such that a ledge is formed along the top edge of the pane 12. The header 70 can be connected to the frame 20 by any conventional means, such as integrally molding the header 70 as part of the frame 20 or connecting the two using an adhesive. The header 70 includes an attachment leg 106. The attachment leg 106 is a short protrusion extending at a right angle from the back leg 108 of the header 70 such that the back leg 108 of the header 70 lies flat against the pane 12 and the attachment leg is connected to the interior of the frame 20. The header 70 further includes a base leg 110 having slots 112 for the connection of the tilt control mechanism 24 and height control mechanism 26 to the frame 20. Each slot 112 is a substantially rectangular groove in the base leg 110 of the header 70.

As seen in FIGS. 4 and 5, the tilt control mechanism 24 includes a tilt actuator 84, which is slidably mounted along the left side 32 of the frame 20. The tilt actuator 84 includes a spine 86 that protrudes from the tilt actuator 84 and fits within a groove 85 present along the left side 32 of the frame. The spine 86 is preferably a substantially rectangular protrusion and the groove 85 is preferably substantially U-shaped, the height of the spine 86 being approximately equal to the depth of the groove 85. Additionally, the tilt actuator 84 includes a rearward extending connector 88 for connecting to the remainder of the tilt control mechanism 24, as will be explained in more detail below. The connector 88 extends inwardly from this the groove 85 into the interior of the frame 20. Preferably, a portion of the edge of the frame is cut away along the groove 85 to facilitate movement of the tilt actuator 84, the tilt actuator 84 being positioned along this cut-away portion 87.

The remainder of the tilt control mechanism 24 is located within the interior of the frame 20 and is not visible to the user. The tilt control mechanism 24 further includes a tilt belt 90 attached to the tilt actuator 84 by the connector 88. The tilt belt 90 wraps around a tilt gear 92 that is affixed to a tilt bar 94, preferably with screws or adhesive. The tilt belt 90 preferably includes grips 98 that interfit with teeth 100 on the gear to provide a more secure grip between the two. A tilt control gear 93 is essentially identical to the tilt gear 92 and is mounted at the bottom of the frame 20. The tilt gear 92 and tilt control gear 93 control rotation of the tilt belt 90 during operation of the assembly 10. The tilt belt 90 is most preferably molded from plastic, although other suitable materials such as rubber and fabric may be used. A portion of the tilt belt 90 optionally consists of a spring 102, the spring 102 accounting for thermal expansion of the resulting belt. The tilt bar 94 extends lengthwise within the interior of the header 70 and is supported within barrel 114 which snaps into the floor of the header 70. The front and rear tilt adjustment cords 78 and 79 are secured to the tilt bar 94.

The tilt gear 92 and tilt control gear 93 are housed within baskets 104. Each basket 104 includes two side walls 106 and a back wall 108. Each side wall includes a nesting portion 110, which is a substantially semicircular ridge along the top edge of the wall. The tilt gear 92 and tilt control gear 93 rest on the nesting portions 110 of the side walls 106. The back wall 108 connects the basket 104 and is attached to the frame 20. The back wall 108 can be connected to the frame 20 by any conventional means, such as screwing the back wall 108 onto the frame 20 or attaching the two with an adhesive.

The height control mechanism, or adjuster, 26 includes a height actuator 120 which is slidably mounted on the right side 34 of the frame 20. The height actuator 120 is essentially identical to the tilt actuator 84 and includes a spine 122 which interfits with a groove 124 on the right side 34 of the frame 20. As with the tilt control mechanism 24, the groove 124 preferably includes a cut-away portion to facilitate movement of the height actuator 120, and thus adjustment of the blinds 22. The height actuator 120 further includes a connector 126 that connects the height actuator 120 to the height control mechanism 26.

The connector 126 of the height actuator 120 is attached to a height belt 128 which is wrapped around an adjustment gear 130 and adjustment control gear 131, which are housed in baskets 104. The height belt 128, adjustment gear 130 and adjustment control gear 131 are essentially identical to the tilt belt 90, tilt gear 92 and tilt control gear 93, and therefore will not be described in further detail. The height control mechanism 26 further includes an adjustment rod 136, a threaded rod 138, and a rod support 140. The adjustment rod 136 is a substantially circular rod that is connected to the adjustment gear 130 such that when the adjustment gear 130 rotates, the adjustment rod 136 rotates. Optionally, a bar can be used to connect the adjustment gear 130 to the adjustment rod 136. The adjustment rod 136, or at least a substantial portion thereof, is hollow and is internally threaded. The adjustment rod includes throughholes 137 through which the second ends 76 of the lift cords 72 are threaded. The first ends of the lift cords 72 are preferably knotted to secure them to the adjustment rod 136. A cap 139 is also connected to the second end 76 of each lift cord 72 around the knotted portion to further ensure the connection of the lift cords 72 to the adjustment rod 136.

The threaded rod 138 is a substantially circular rod having threads along substantially its entire the length, the threads of the threaded rod 138 corresponding to the threads of the adjustment rod 136 so that threaded rod 138 can be screwed into the adjustment rod 136. One end of the threaded rod 138 is screwed at least partially into the adjustment rod 136 and the opposite end of the threaded rod 138 being rigidly connected to the rod support 140, such that as the adjustment rod 136 rotates the adjustment rod 136 is screwed onto the threaded rod 138. The rod support 140 preferably includes a circular portion 142 that houses an end of the threaded rod 138 and prevents the threaded rod 138 from rotating during operation of the assembly 10. The rod support 140 also preferably includes a clamp 144 that is connected to the header. The clamp 144 is preferably substantially U-shaped and interfits with the base leg 110 of the header 70 to connect the rod support 140 to the header 70, and thus the frame 20. Alternatively, the rod support may be connected to the header 70 by other conventional means, such as the use of glue or fasteners.

Each of the adjustment rod 136 and tilt bar 94 extends through barrels 114, thus connecting the tilt control mechanism 24 and height control mechanism 26 to the barrels 114. Barrels 114 include catches 116 that interlock with the slots 112. Each barrel 114 is essentially two figure-8 shaped sections, each section having a large circle 118 beneath a small circle 120. A base 122 is attached to the bottom of each large circle 118 and extends between the two sections to connect them. A catch 116 is a substantially T-shaped protrusion that extends from the bottom of each base 122. Each catch 116 is designed to "snap" fit with a slot 112 on the header 70 to connect the tilt control mechanism 24 and height control mechanism 26 to the header 70.

Figure 8:
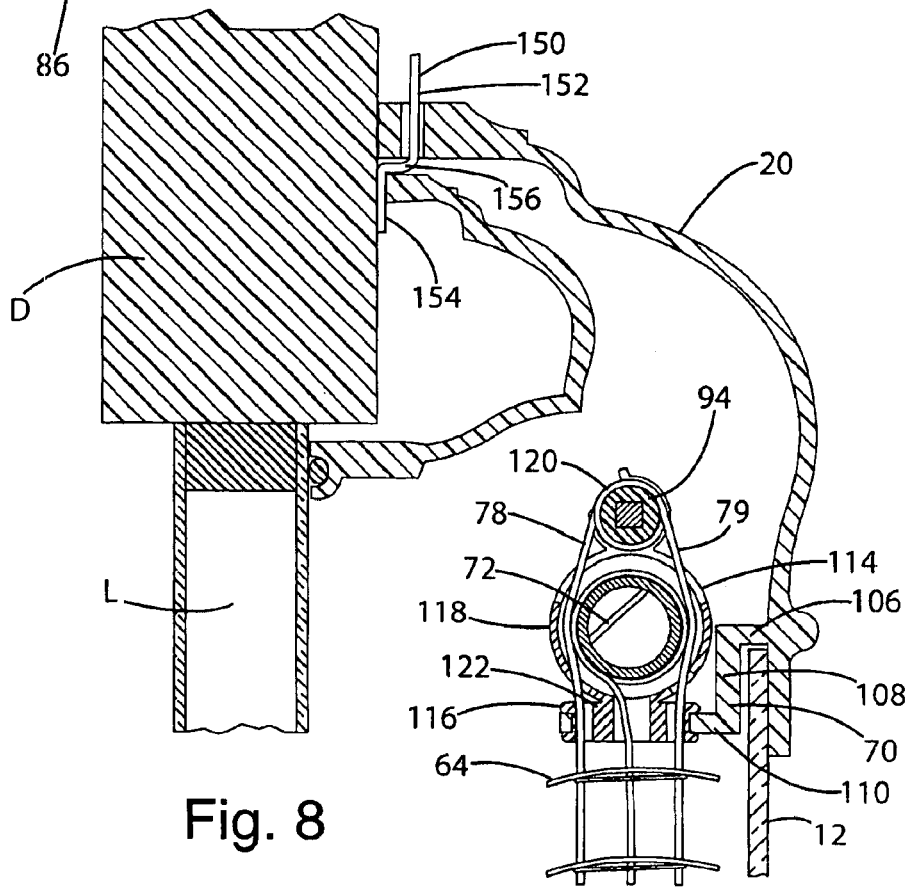
FIG. 8 is a fragmentary side cross-sectional view of the door of FIG. 1 taken along line VIII—VIII.
Figure 6:
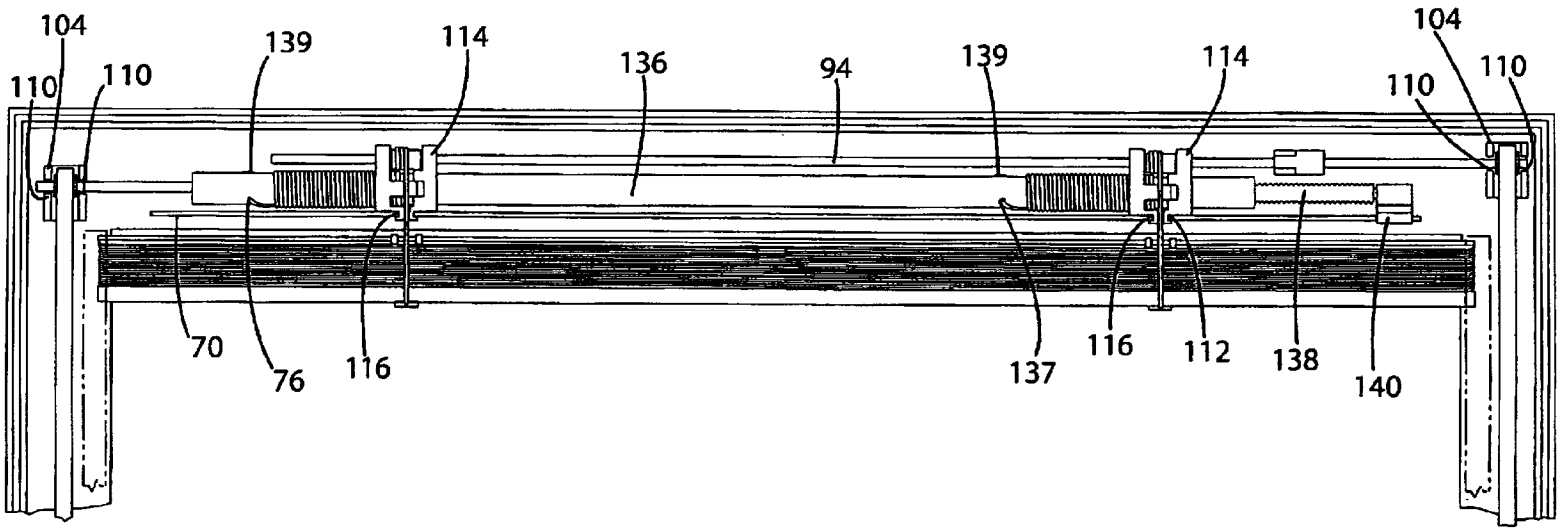
FIG. 6 is a rear elevational of the interior of the header of the blind assembly.
Figure 7:
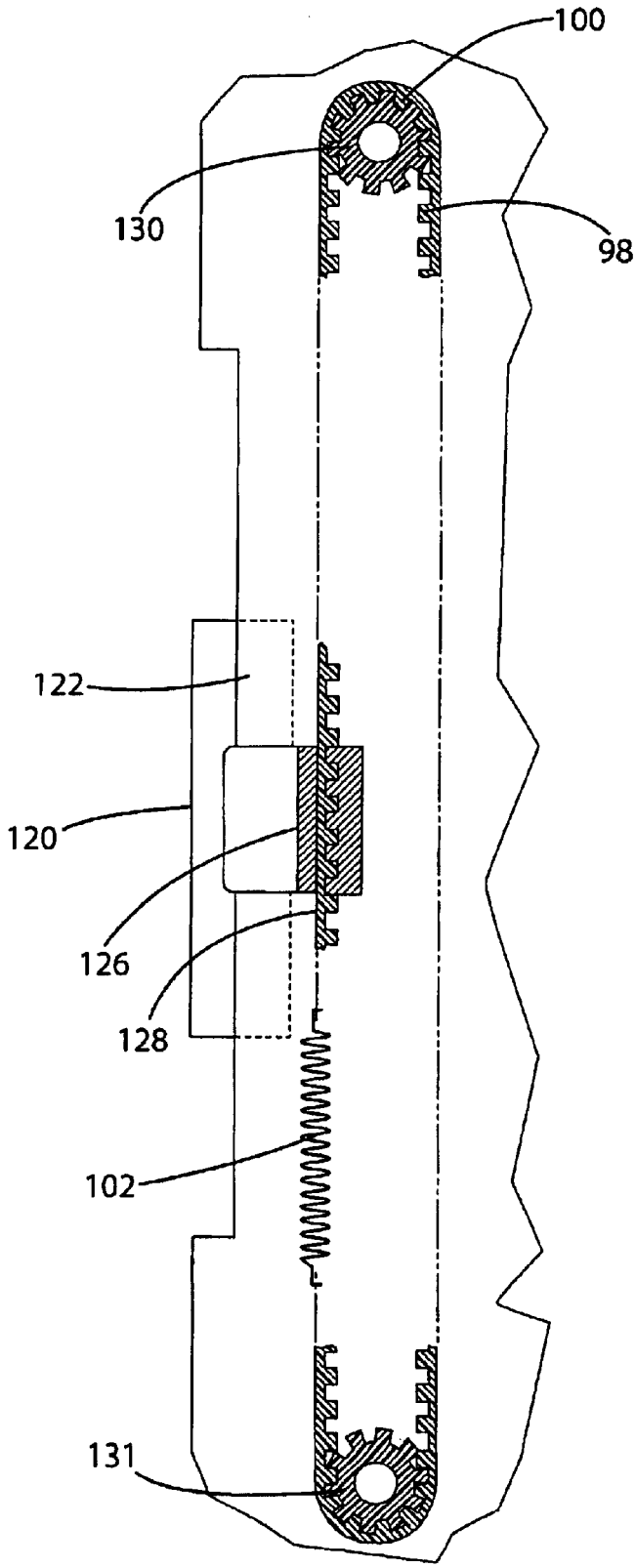
FIG. 7 is a side cross-sectional view of the height control mechanism taken along line VII—VII in FIG. 3.

As can perhaps be best seen in FIG. 8, latches 150 are connected along the top side 28 of the frame 20. Each latch 150 includes a short frame leg 152 connected to the top side 28 of the frame 20 and a door leg 154 that is substantially longer than the frame leg 152 and extends in a direction opposite that of the frame leg 152. An intermediate leg 156 connects the frame leg 152 and door leg 154 and is preferably perpendicular to them both. There are preferably at least two latches 150 connected along the top side 28 of the frame 20. Latches 150 can be formed from any materials, but are preferably metal, and can be connected to frame 20 in any conventional manner.

Figure 9:
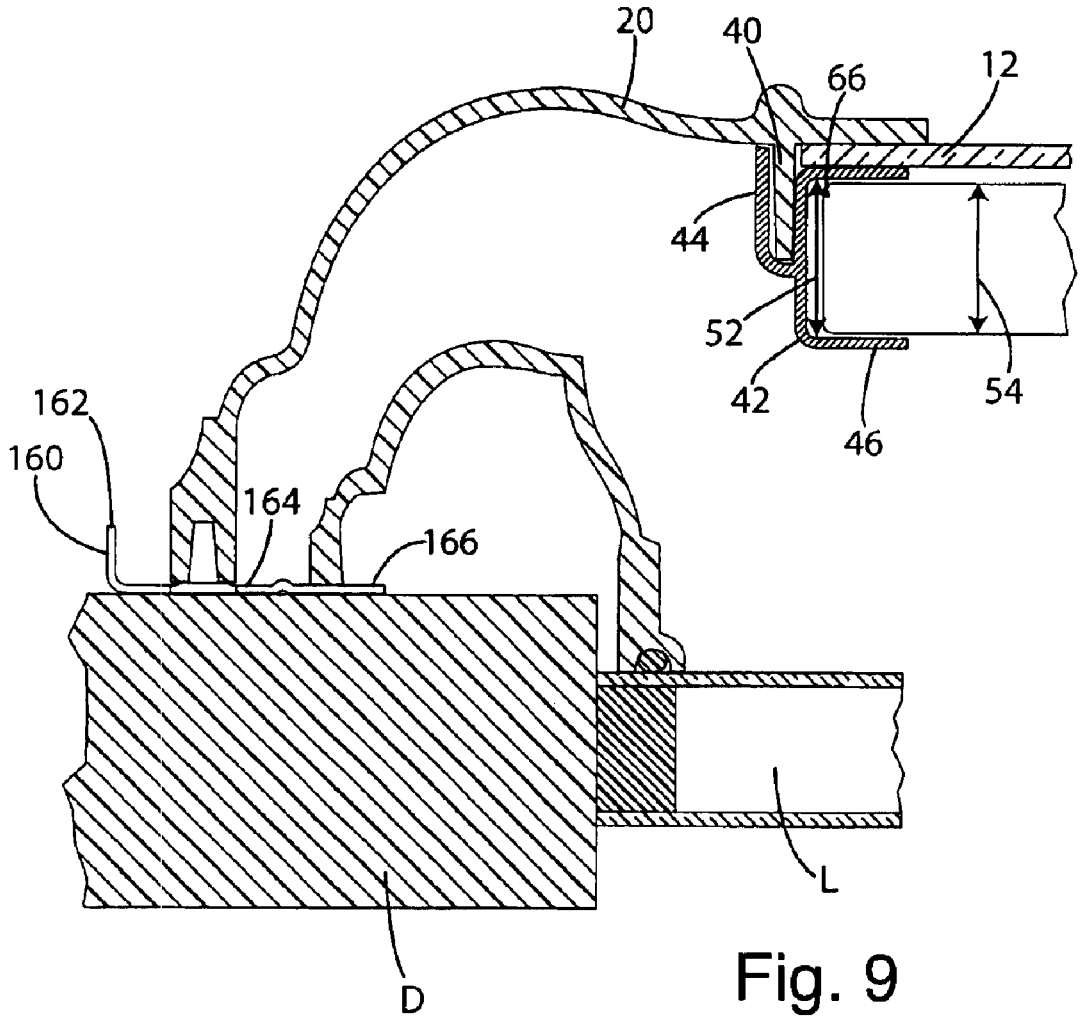
FIG. 9 is a fragmentary bottom cross-sectional view of the door of FIG. 1 taken along line IX—IX.
Figure 9A:
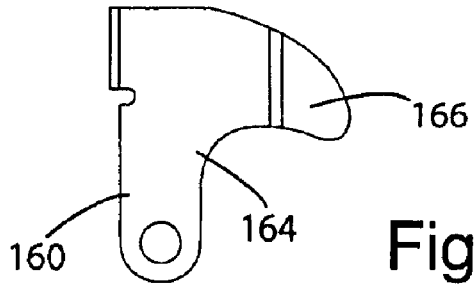
FIG. 9A is a front elevational view of a clip of the assembly.

As can be seen in FIG. 9, clips 160 are connected along either the bottom side 30 or a lower portion of both the left and right sides 32, 34 of the frame 20. Each clip 160 is substantially L-shaped and includes a base leg 164 and an extending leg 166. Each clip 160 optionally includes a substantially rectangular lip 162 extending perpendicularly from the base leg 164 of the clip 160. The clips 160 are rotatably connected to the frame 20 such that, if the lip 162 is pulled, the clip 160 rotates. The clips can be connected to the frame by any conventional means, but are preferably connected to the frame 20 with screws.

II. Operation

The assembly 10 is preferably installed over the doorlight of an existing door. However, the assembly 10 may be used in conjunction with any window style or with windows in any type of structure, such as a home or office building.

Before installing the assembly, the blinds 22 must be installed. To install the blinds 22, the catches 116 of the barrels 114 connected to the tilt control mechanism 24 and the height control mechanism 26, which in turn are connected to the blinds 22, are snapped into slots 112 on the header 70. To change the color of the blinds, the barrels 114 can be detached from the header 70 and new barrels 114, with new blinds 22, can be snapped in.

After installing the blinds, the assembly 10 is positioned so that the blinds 22 are sandwiched between the pane 12 and the existing doorlight. To install the assembly 10 on a doorlight, the latches 150 of the assembly 10 are first placed over the existing frame of a doorlight in such a manner as to allow the door leg 154 of each latch 150 to "snap" in between the frame of the existing doorlight and the door. The snapping interaction of the latches 150 and the existing frame provides a secure connection of the assembly to the door.

After connecting the assembly 10 to the door, the clips 160 are rotated such that the extending leg 166 of each clip 160 "snaps" between the frame of the existing doorlight and the door. In this case, the securing of the clips 160 between the doorlight frame and door prevents the assembly 10 from swinging or swaying as the door is opened or closed or during windy conditions.

To raise or lower the blinds 22, the user grasps the height actuator 120 of the height control mechanism 26 and slides height actuator 120 vertically along the cut away portion 132 of the groove 124. As the user slides the height actuator 120 down, the height belt 128 is moved downward, thus rotating the adjustment gear 130 and, in turn, the adjustment rod 136. As the adjustment rod 136 rotates, it is threaded onto the threaded rod 138 and the lift cords 72 are coiled onto the adjustment rod 136, thus pulling the slats 64 vertically upward. The slats 64 may be raised to any height desired by the user. When the slats 64 are raised to the desired position, the user ceases sliding the height actuator 120 down the track 40.

To lower the blinds 22, the user slides the height actuator 120 vertically upward along the groove 124. As the height belt 128 is pulled upward, the adjustment gear 130 is rotated in the opposite direction, causing the lift cords 72 to unwind from the adjustment rod 136 and lower the slats 54.

To open the blinds 22, the user grasps the tilt actuator 84 and slides it along the groove 85 along the left side 32 of the frame 20 to the middle of the left side 32. As the tilt actuator 84 is moved, the tilt belt 90 is moved causing the tilt gear 92 to rotate. As the tilt gear 92 rotates, the tilt cords 74 are twisted causing the slats 64 to rotate. When the tilt actuator 84 is positioned in the middle of the assembly 10, the front and rear tilt cords 74 are level, and the connector cords are horizontal. Thus, the slats 64 lie in a horizontal position, and the blinds 22 are opened. To close the blinds 22, the user slides the tilt actuator 84 to upwards or downwards from the middle position. This causes the tilt gear 92 to rotate, thus rotating the tilt bar 94 and causing the tilt cords 74 to twist. As the tilt cords 74 twist, one edge of the slats 64 is pulled upward causing the blinds to close.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A door assembly comprising:

a door including a doorlight, said doorlight including a doorlight frame;

an assembly frame having an upper portion and a lower portion;

a transparent panel supported by said assembly frame;

a blind supported by said assembly frame; and mounting means for mounting said assembly frame on the door and over the doorlight, said mounting means including at least one bracket having first and second portions, said first portion of said bracket fitting between the door and an upper portion of the doorlight frame, said second portion of said bracket extending above the doorlight frame, said second portion of said bracket hingedly supporting said upper portion of said assembly frame whereby said assembly is supported on said bracket and can swing about said bracket, said mounting means further including at least one movable clip on said lower portion of said assembly frame, said clip including a portion and being movable between a release position in which said assembly can be removed from said brackets and a secured position wherein said portion of said clip fits between the door and the doorlight frame, preventing said frame from pivoting about said bracket.

2. A door and window blind assembly comprising:

a door including a doorlight, said doorlight including a doorlight frame; and a retrofit window blind assembly comprising:

a frame having an upper portion and a lower portion and defining a pane opening;

a pane positioned within said pane opening and connected to said frame;

a blind supported by said frame;

a bracket having a first portion secured between said door and said doorlight frame and a second portion hingedly supporting said upper portion of said frame; and a movable latch connected to said lower portion of said frame, said latch including a leg capable of moving between a locked position between said door and said doorlight frame and an unlocked position free of said doorlight frame.

3. The assembly of claim 2 further including clips along a bottom portion of said frame, said clips being rotatably mounted to said bottom portion of said frame such that said clips fit between the door and the existing doorlight frame to secure the frame against said door.

4. The assembly of claim 3 further including lift cords on said blinds and a height control mechanism for moving said blinds in a vertical direction attached to said lift cords.

5. A door and window blind assembly comprising:

a door including a doorlight, said doorlight including a doorlight frame; and a retrofit window blind assembly comprising:

a frame having an upper portion and a lower portion and defining a pane opening;

a pane positioned within said pane opening and connected to said frame;

a blind supported by said frame, said blind including lift cords on said blind and a height control mechanism for moving said blind in a vertical direction attached to said lift cords, wherein said height control mechanism further includes a height actuator and said frame further includes a first groove along at least one of said first side, said second side and said third side, said height actuator being slidably mounted on said first groove;

a bracket having a first portion secured between said door and said doorlight frame and a second portion hingedly supporting said upper portion of said frame; and clips along a bottom portion of said frame, said clips being rotatably mounted to said bottom portion of said frame such that said clips fit between said door and said existing doorlight frame to secure said frame against said door.

6. The assembly of claim 5 further including adjustment cords on said blinds and a tilt control mechanism for opening and closing said blinds attached to said adjustment cords.

7. The assembly of claim 6, wherein said tilt control mechanism further includes a tilt actuator and one of said first side, said second side and said third side includes a second groove, said tilt actuator being slidably mounted along said second groove.

8. A retrofit window blind assembly for attaching to a door over the frame of an existing doorlight, comprising:

a frame having an upper portion and a lower portion and defining a pane opening;

a pane positioned within said pane opening and connected to said frame;

a blind supported by said frame;

a bracket having a first portion adapted to be secured between the door and the doorlight frame and a second portion hingedly supporting said upper portion of said frame; and a movable latch connected to said lower portion of said frame, said latch including a leg adapted to move between a locked position wherein said leg is positioned between the door and the doorlight frame and an unlocked position free of said doorlight frame.

* * * * *